US005205632A

United States Patent [19]

Crinion

[11] Patent Number: 5,205,632

[45] Date of Patent: Apr. 27, 1993

[54] UNDERCABINET LAMP

[75] Inventor: Jonathan Crinion, Toronto, Canada

[73] Assignee: Esmond Manufacturing Inc., Scarborough, Canada

[21] Appl. No.: 894,614

[22] Filed: Jun. 5, 1992

[51] Int. Cl.[5] ..... F21M 3/20; F21V 7/14

[52] U.S. Cl. ..... 362/33; 362/223; 362/260; 362/309; 362/347; 362/398

[58] Field of Search ..... 362/33, 133, 223, 260, 362/307, 308, 309, 327, 347, 398

[56] References Cited

U.S. PATENT DOCUMENTS 4,383,289 5/1983 Lewin ..... 362/33

4,617,612 10/1986 Pritchett ..... 362/398 X

OTHER PUBLICATIONS

Ultralite Sale Literature, Series A100 Modular Task-light, PWG, Inc.; Flushing, N.Y. (no date).

*Primary Examiner*—Allen M. Ostrager

[57] ABSTRACT

A task light is disclosed which has a base which is releasably securable to a support surface. A light reflector cavity is shaped to provide different zones of light intensity. A longitudinal light source is positioned within the cavity and a peripheral rim member of varying surface area about the lamp base serves to diffuse the light by reflecting a portion of the light and allowing a portion of the light to pass therethrough. The light reflecting cavity has a particular profile for providing a desired light distribution and is angled relative to the base, which is also of a particular shape having varying sized sidewalls to enhance the light distribution. In a preferred embodiment, the base, the peripheral rim and the light reflecting cavity all cooperate for ease of assembly and manufacture of the components.

15 Claims, 5 Drawing Sheets

UNDERCABINET LAMP

FIELD OF THE INVENTION

The present invention relates to task lights including desk lights, and in particular, to lights which can be secured beneath office accessories hung from office panelling systems.

BACKGROUND OF THE INVENTION

Office panelling systems are now recognized as providing a suitable alternative for subdividing office space and defining individual work stations. These systems not only provide support for work surfaces, they are also used to support filing cabinets which are typically hung from the office panelling system and are commonly referred to as overhead cabinets. Such overhead cabinets provide storage for the particular work station, however, they tend to reduce the amount of light available at the work surface immediately therebelow. To address this problem, there are overhead cabinets having a fluorescent type fixture secured to the bottom thereof for providing additional light. Although this provides additional light, it is not a solution that is easily installed by a user in the field, nor has the light produced by the arrangement been directed in a variable manner for lighting the work surface.

There remains a need to provide a simple solution for providing additional light at a work station.

SUMMARY OF THE INVENTION

A task light, according to the present invention, comprises a base releasably securable to the support surface, a light reflector cavity shaped to provide areas of different light intensity, a longitudinal light source positioned within the cavity, and a peripheral rim member of varying surface area about the lamp base which further diffuses the light by reflecting a portion of the light and allowing a portion of the light to pass therethrough.

According to an aspect of the invention, the reflector cavity is orientated at a shallow angle relative to the base.

According to yet a further aspect of the invention, the cavity is shaped to have a similar profile along the length of the lamp or light source and provides a level of high light intensity immediately below the lamp, a zone of decreasing light intensity to one side of the light source, and a zone of low light intensity to the rear of and below the task light. This light distribution is particularly advantageous with respect to overhead cabinets, as the area of low light intensity would normally be placed adjacent the panel and the high light intensity and zone of decreasing light intensity are positioned to illuminate the work surface forward of the zone of low light intensity. It can be appreciated that light to the rear would essentially be lost or severely diffused (i.e. due to striking an upholstered panel) and, therefore, with the task light, more of the produced light is used for the desired purpose, i.e. effectively illuminating the work surface.

According to yet a further aspect of the invention, the base includes the magnetic attaching substrate secured thereto whereby the task light may be secured below an iron base surface (commonly steel) and maintained there by the magnetic attaching substrate, magnetically engaging the iron base surface.

The task light is also designed for ease of manufacture and the peripheral rim, the light reflecting cavity member and the base cooperate to simplify assembly. The various members are preferably elliptical or non-rotatable, one within the other, and the base and the peripheral rim have varying sized peripheral walls. The light reflecting cavity member closes the interior of the base and cooperates with the base for locating of electrical components in the space between the base and the light reflecting member, all held in place by a simple, preferably single mechanical connection.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
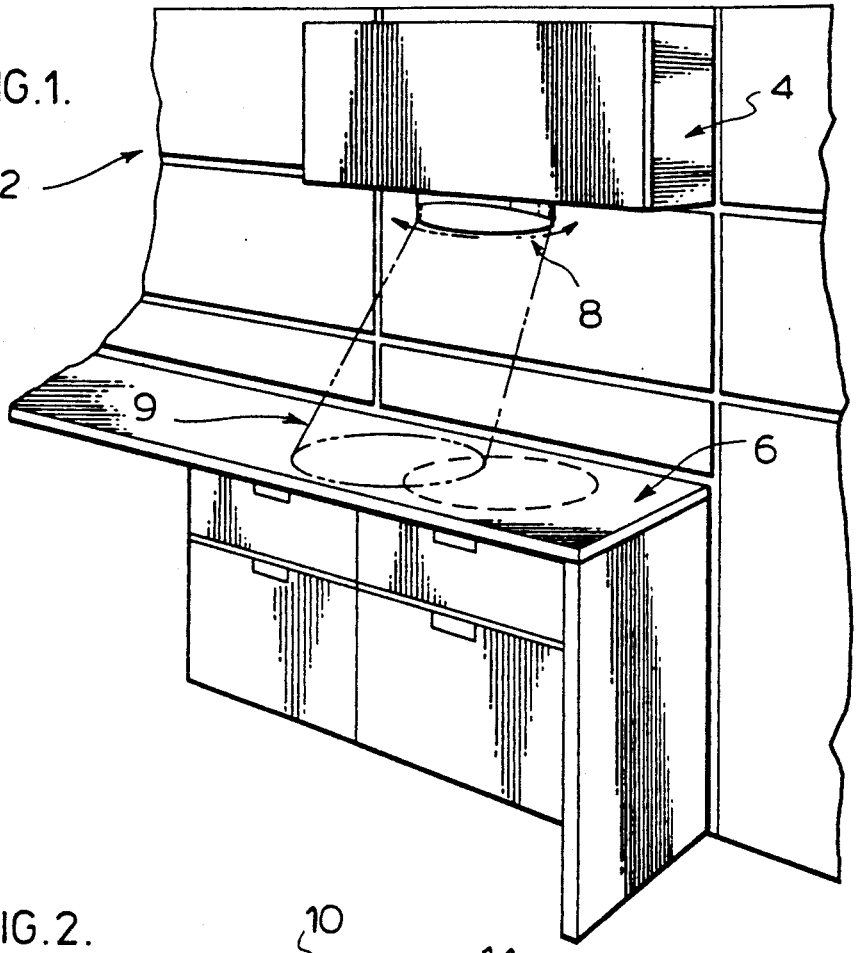
FIG. 1 is a partial perspective view of an office panelling system with an overhead cabinet and task light secured therebelow.

The office panelling system 2 can support hanging metal filing cabinets or overhead cabinets 4 which are typically placed above a work surface 6. The depth of the metal cabinet is approximately half that of the work surface. A typical overhead cabinet may be about 14 inches in depth. The work surface 6 is typically illuminated from overhead lighting fixtures in the ceiling and the placement of the overhead cabinet 4 will reduce the amount of light available at the work surface 6. To overcome this problem, task light 8 is secured beneath the overhead cabinet 4 and provides additional light, the distribution of which is identified as 9. This distribution of light is asymmetrical and is designed to project forward of the task light 8 as well as directly therebelow. The amount of light extending rearwardly is much less than the amount of light projecting forwardly. This asymmetrical light distribution is due to a particular cooperation of the elements of the task light, which will be subsequently described.

Figure 2:
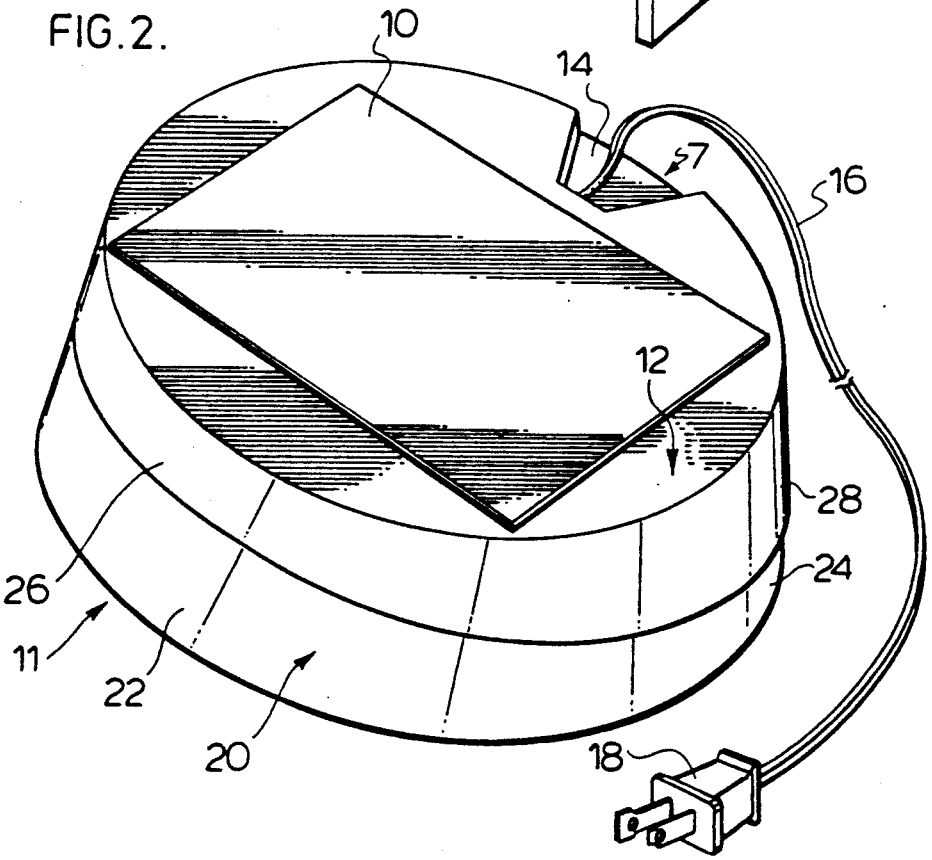
FIG. 2 is a perspective view of the task light.

The task light, as shown in FIG. 2, preferably has a magnetic attaching substrate 10 secured to the base 12 of the task light. With this arrangement, the task light may be secured to the lower surface of the overhead cabinet 4 and is held there due to the magnetic attraction of the substrate 10 and the lower surface of the overhead cabinet 4. These overhead cabinets are typically of an iron based material (steel) and, thus, magnetic attraction is possible.

The base 12 includes a notched out region 14 at the rear surface 7 of the task light 8 through which the electrical power cable 16 leaves the interior of the base 12. The power cord 16 includes an electrical plug 18 which can pass through the interior of the office panelling system 2 to a suitable source of electrical power. These office panelling systems typically have power within the individual panels and the electrical connection is made interior to the panels.

Figure 3:
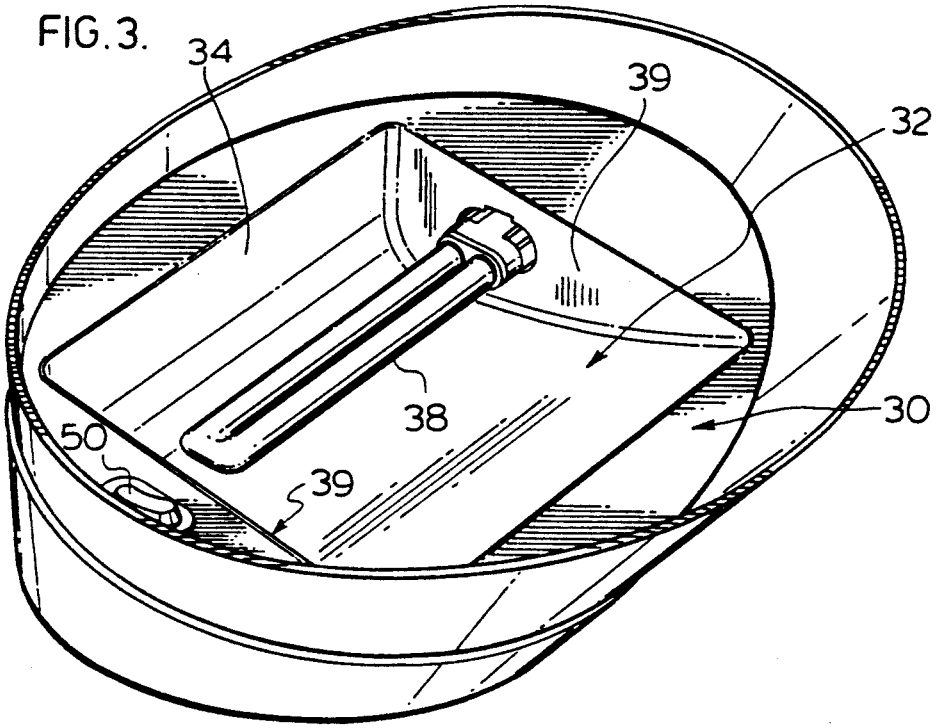
FIG. 3 is a perspective view of the task light showing the interior of the light.

Connected to the base 12 is the peripheral rim 20 which is a flexible, translucent member allowing a small portion of the light incident thereon to pass therethrough and a portion of this light incident is reflected. The sidewalls of the peripheral rim member are not all equal and there is a larger wall 22 adjacent the front surface 11 of the task light 8. The opposite wall of the peripheral rim, i.e. at the rear surface 7 of the task light, is much smaller and is shown as 24. It can be seen that the sidewall of the base member at the front surface 11 of the task light 8 is much smaller and is indicated as 26. The opposite rear wall 28 of the base 12 is much larger. Thus, the peripheral rim member at the front surface 11 of the task light is much larger and a smooth type transition occurs to the reduced peripheral rim sidewall, indicated as 24, at the rear of the task light. These members cooperate with walls 26 and 28 of the base and together help to form the asymmetrical light distribution referred to in FIG. 1. The fact that the peripheral rim is flexible reduces the possibility of damage, as the rim will resiliently yield if inadvertently contacted or struck. It is also possible for the peripheral rim to be opaque. Details of this can be appreciated from a review of FIGS. 3 and 4.

Figure 4:
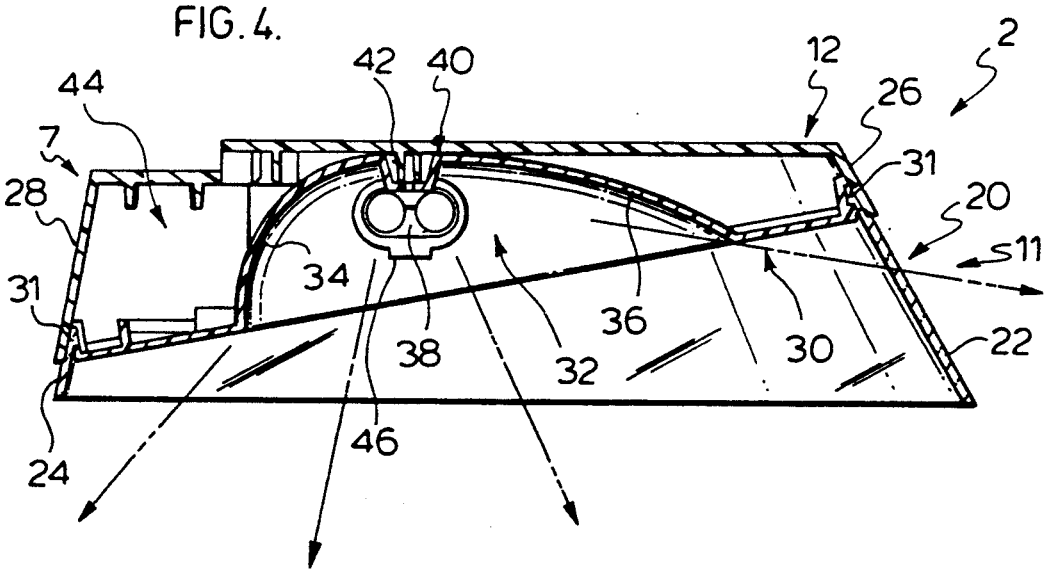
FIG. 4 is a sectional view through the task light.

As can be seen in FIG. 4, the light reflecting member, generally indicated as 30, has a light receiving cavity 32 with a generally abrupt rear wall 34 and a generally open or shallow front wall 36. This arrangement allows more of the light produced by the light source 38 to be radiated forwardly of the task light and much less of the produced light to radiate towards the rear of the task light, indicated by 7. The light source 38 is a longitudinally extending lamp and the cavity 32 is of a similar section along the length of the lamp and is generally closed at either end by the end walls 39 shown in FIG. 3. These walls are generally perpendicular to the bottom surface of the base as is the rear wall shown as 34. It can be appreciated that there is a curved merging of the rear wall 34 with the front wall 32, which transition occurs to the rear of the light source 38.

Figure 5:
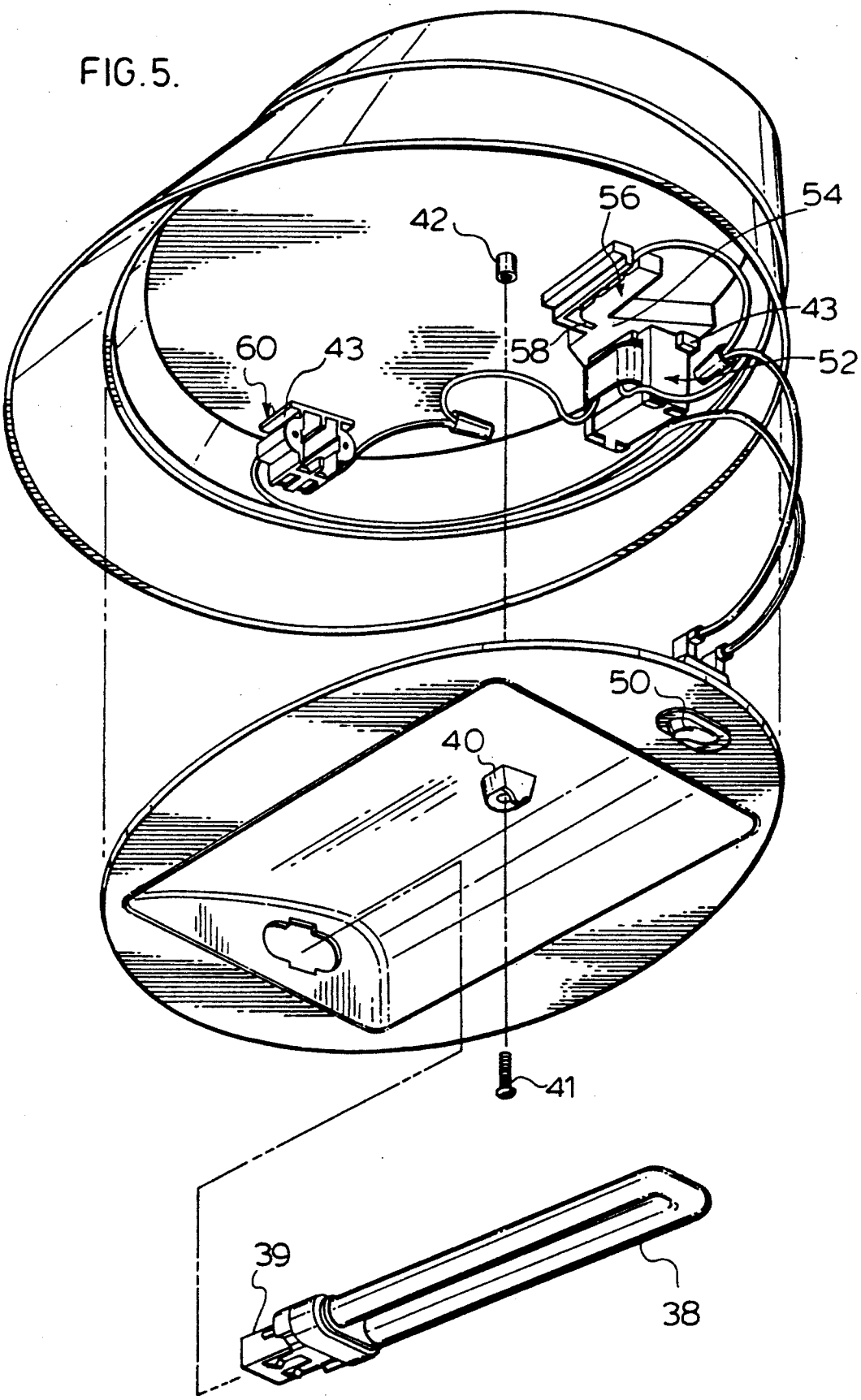
FIG. 5 is an exploded perspective view of the task light.

Cooperation of the various elements of the task light 8 can be appreciated from a review of FIGS. 4 and 5. The peripheral rim 20 has a snap fit type connection with the light reflecting member 30 at positions 31 shown in FIG. 4. These snap fit locations can be discrete tabs at spaced locations about the periphery of the rim 20 and the light reflecting member 30. These two members are secured within the base 12 which can have a number of tabs to accurately locate the rim 20 and the light reflecting member 30 at a specific position and angle in the base 12. These components will tend to accurately locate due to the fact that they are elliptical (or other non-circular shape) rather than circular. Once so located, the common light source support and securing port 40 of the light reflecting member 30 is positioned immediately above the plug 42 integral with the base 8. Plug 42 receives the screw or bolt 41 indicated in FIG. 5. Thus, the one bolt 41 will serve to maintain the assembled components of the base 12, the rim 20 and the light reflecting member 30. The cooperation of the light reflecting member 30 and the base 12 also secures and maintains the position of the power transformer 52 and the lamp connector 60. The power transformer 52 is accurately located within appropriate guide pins 43 of the base, with these guide pins being adapted to engage and locate the transformer 52 and the lamp connector 60. Therefore, these electrical components may be assembled in the base and then the light reflecting member 30 and the rim 20 brought into the assembled configuration. The light reflecting member, on the rear surface, also has guide pins or guide surfaces for maintaining of the transformer 52 and the lamp connector 60. Thus, the securing of the components and the fastening of the components by the common bolt 41 secures not only secures the individual components, namely the peripheral rim, the light reflecting member and the base 12, but it also serves to secure in the cavity, between the light reflecting member 30 and the base 12, the additional electrical components 52 and 60.

The power for the transformer 52 is brought into the interior of the base through port 58, and channel arrangement 56 is provided for anchoring of the power cord. The light reflecting member 30 can have preassembled therewith the light switch 50 for turning the task light on or off. The light reflecting member 30 can also be molded with a port 46 through which the light source 38 extends with the power connection 39 thereof engaging the lamp connector 60.

Figure 6:
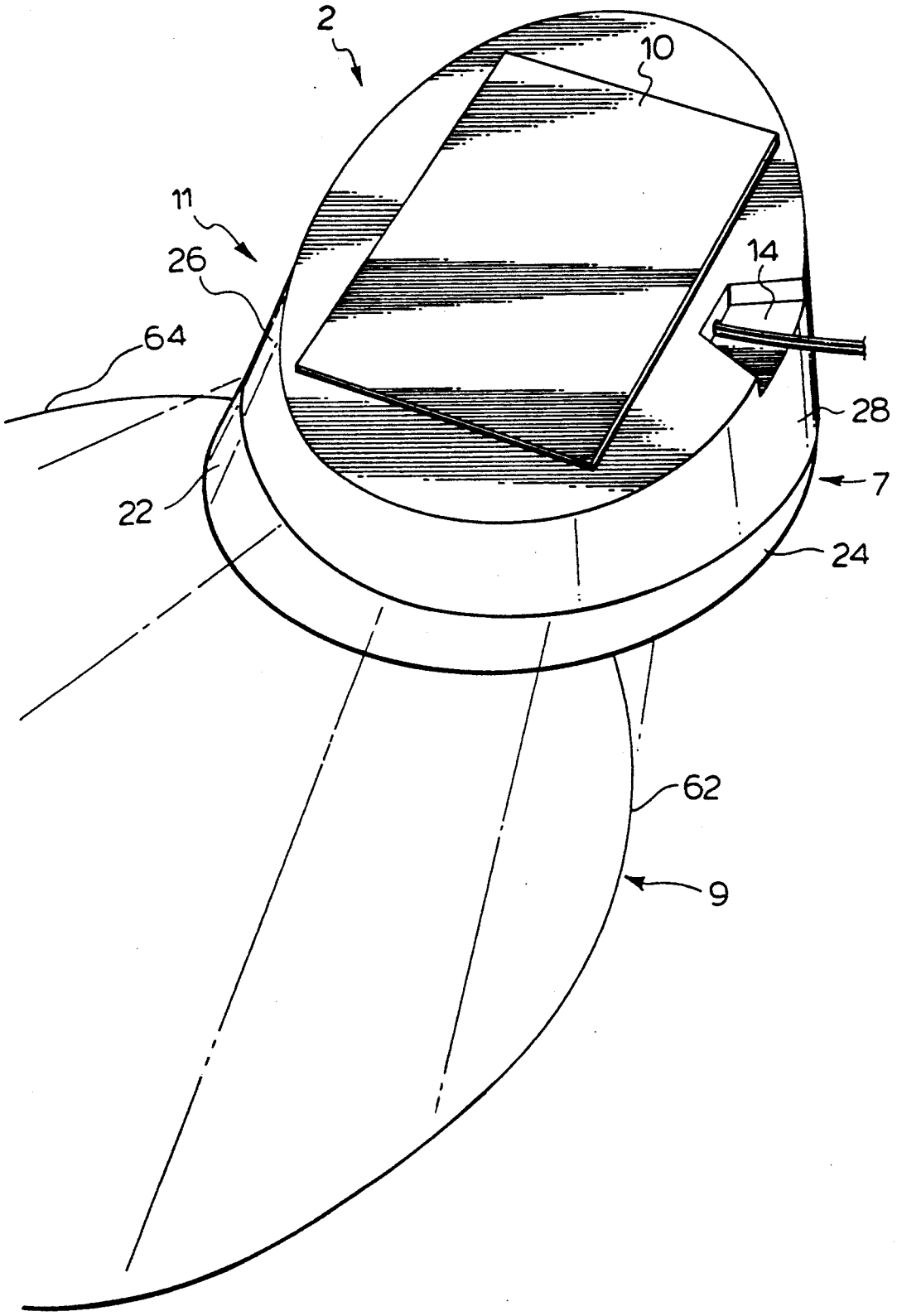
FIG. 6 is a perspective view showing the task light from above and a portion of the light distribution therebelow.
Figure 7:
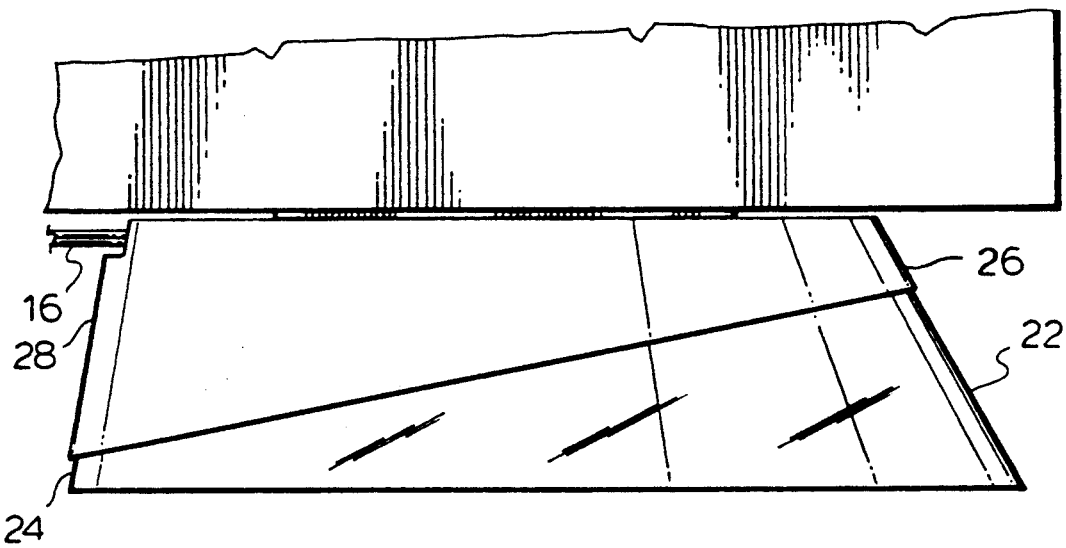
FIG. 7 is a side view of the task light.
Figure 8:
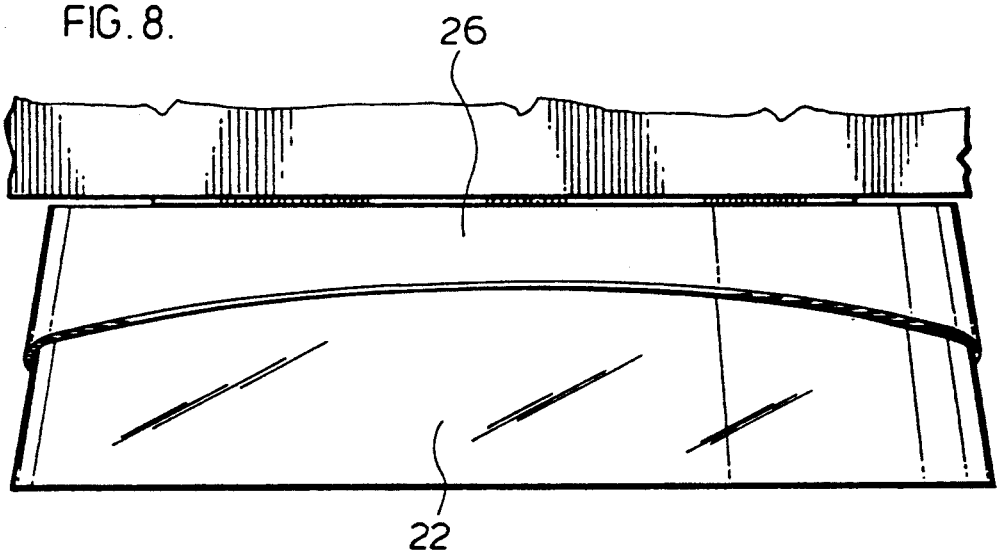
FIG. 8 is a front view of the task light secured below an office panel.

As shown in FIG. 6, the light distribution produced by the lamp is generally directed to the front of the task light and very little light is provided to the rear surface 7 of the task light. It can be seen that the light reflecting member is at a shallow angle to the base 12 (about 15° to 30°) and this angle assists in directing the light forwardly and downwardly. Similarly, the small sidewall 24 of the peripheral rim reduces the amount of light radiated to the rear of the task light 8. It can be seen from FIG. 6 that the light distribution has a rear edge 62 generally immediately below the rear of the task light or slightly rearwardly therefrom and the light distribution has a forward type edge indicated as 64 which would be considerably forward of the front 11 of the task light 8.

Although the peripheral rim 20 has varying sidewalls, it cooperates with the varying sidewalls of the base 12 to produce a task light which is generally of a common depth. Thus, it can be seen that the overall depth of the task light at the front surface is generally equal to the depth of the task light at the rear surface. This is somewhat desired from an aesthetic point of view and to hide the light source, but the desired reflecting and light transmitting properties as well as the angling of the light reflecting member 30 have been accomplished while maintaining the desired overall equal depth.

The base 8 is preferably made by injection molding, the peripheral rim 20 can be made by injection molding, and, similarly, the light reflecting member 30 can be made by injection molding. Thus, the various guide pins, etc. can be an integral part of the mold and only three major components are required for producing the housing of the task light having a closed central cavity. These components also cooperate for securing of the individual electrical components between the light reflecting member 30 and the base 12. The task light provides simple securement and assembly due to the cooperation of the individual major components.

The task light can be easily installed by the end user by merely placing the task light immediately underneath an overhead cabinet, as indicated in FIG. 1. The task light is held in this position by means of the magnetic substrate 10. Should the user decide that he requires an increase in light to the front surface of the work surface 6, he can merely adjust the location of the task light beneath the cabinet. Should he desire to have more light at a different point along the length of the work surface, he can merely move the task light to a different point beneath the overhead cabinet 4. In some cases, he may desire to have a different distribution of light and variations can be accomplished by rotating the task light, such that the front surface is not necessarily aligned with the front surface of the overhead cabinet 4. Therefore, the task light can provide the user with a great deal of flexibility for producing light where it is most desired. The light produced is projected generally forward of the task light, with significantly less light being radiated or reflected to the rear of the task light. The light to the rear provides some lighting, whereas the forward portion of the light distribution is more suitable for work related tasks and is at a higher level.

The task light has been described as including a magnetic substrate for securing thereof beneath a suitable metal overhead cabinet, but other securing arrangements can be used, including mechanical fasteners. The magnetic substrate is convenient and also allows easy relocation for changing needs.

Although various preferred embodiments of the present invention have been described herein in detail, it will be appreciated by those skilled in the art, that variations may be made thereto without departing from the spirit of the invention or the scope of the appended claims.

THE EMBODIMENTS OF THE INVENTION IN WHICH AN EXCLUSIVE PROPERTY OR PRIVILEGE IS CLAIMED ARE DEFINED AS FOLLOWS:

1. A task light comprising a base releasably securable to a support surface, a light reflector cavity shaped to provide different zones of light intensity, a longitudinal light source positioned within said cavity, a peripheral rim member of varying surface area about the lamp base which further diffuses the light by reflecting a portion of the light and allowing a portion of the light to pass therethrough.

2. A task light as claimed in claim 1 wherein said light reflector cavity is orientated at an angle greater than 20°.

3. A task light as claimed in claim 1 wherein said cavity is shaped to have a similar profile along the length of the lamp and provides a level of high light intensity immediately below said lamp and a zone of decreasing light intensity to one side of the light and a zone of low light intensity to the side of said lamp opposite said zone of decreasing light intensity.

4. A task light as claimed in claim 3 wherein said base includes a magnetic attaching substrate secured to said base whereby said task light may be secured below an iron base surface and maintained there by means of said magnetic attaching substrate magnetically engaging the iron base surface.

5. A task light as claimed in claim 1 wherein said base is adapted to secure intermediate said base and said rim cavity a connector for the light source and a power transformer.

6. A task light as claimed in claim 5 wherein said rim cavity closes said base and defines a closed cavity intermediate said base and said rim cavity.

7. A task light as claimed in claim 6 wherein said base and said rim cavity have a single bolt securing the same.

8. A task light as claimed in claim 7 wherein said lensed cavity has a mount for receiving said bolt, said mount also serving as a light source support.

9. A task light as claimed in claim 8 wherein said rim cavity has a port therein through which said light source can engage said connector for the light source.

10. A task light as claimed in claim 9 wherein said rim cavity includes on the side thereof facing said base means for engaging said power transformer to accurately locate and secure said power transformer trapped intermediate said base and said rim cavity.

11. A task light as claimed in claim 10 wherein said base is an injection molded cavity.

12. A task light as claimed in claim 11 wherein rim cavity is an injection molded cavity.

13. A task light as claimed in claim 1 wherein said peripheral rim member is translucent.

14. A task light as claimed in claim 13 wherein said peripheral rim member is injection molded.

15. A task light as claimed in claim 13 wherein said rim cavity and said peripheral rim member cooperate.

* * * * *